United States Patent [19]

Symsek et al.

[11] Patent Number: 4,628,869

[45] Date of Patent: Dec. 16, 1986

[54] VARIABLE TEMPERATURE WASTE HEAT RECOVERY SYSTEM

[75] Inventors: Dale R. Symsek, Franklin Park Borough; Nancy P. Regelin, Bethel Park, both of Pa.

[73] Assignee: United States Steel Corporation, Pittsburgh, Pa.

[21] Appl. No.: 697,173

[22] Filed: Feb. 1, 1985

[51] Int. Cl.[4] ..... F22B 33/00

[52] U.S. Cl. ..... 122/20 B; 122/1 A; 122/7 R; 236/14

[58] Field of Search ..... 122/20 B, 1 R, 1 A, 122/1 B, 448 R, 448 B, 7 R; 236/14; 165/1, 134 DP

[56] References Cited

U.S. PATENT DOCUMENTS

| | | | |
|---|---|---|---|
| 1,226,516 | 5/1917 | Hill . | |
| 1,275,193 | 8/1918 | Alsobrook . | |
| 1,896,671 | 2/1933 | Heaps . | |
| 2,080,229 | 5/1937 | Ray | 122/20 |
| 2,699,758 | 1/1955 | Dalin | 122/1 |
| 3,405,509 | 10/1968 | Coggins | 55/160 |
| 3,405,759 | 10/1968 | Burrus et al. | 165/39 |
| 3,623,549 | 11/1971 | Smith, Jr. | 165/107 |
| 3,844,233 | 10/1974 | Fishback | 110/8 R |
| 4,044,820 | 8/1977 | Nobles | 165/2 |
| 4,053,106 | 10/1977 | Karl | 237/8 R |
| 4,066,210 | 1/1978 | Pemberton et al. | 237/53 |
| 4,084,635 | 4/1978 | Marshall | 165/107 |
| 4,137,965 | 2/1979 | Fallon, Jr. et al. | 165/1 |
| 4,151,259 | 4/1979 | Hollingsworth | 423/167 |
| 4,163,469 | 8/1979 | English | 165/35 |
| 4,180,128 | 12/1979 | Fallon, Jr. et al. | 165/76 |
| 4,196,776 | 4/1980 | Fallon, Jr. et al. | 165/76 |
| 4,227,647 | 10/1980 | Eriksson | 237/2 B |
| 4,230,173 | 10/1980 | Eastman et al. | 165/1 |
| 4,257,579 | 3/1981 | Bruhn et al. | 266/141 |
| 4,258,878 | 3/1981 | Van Pachtenbeke | 237/8 R |
| 4,272,256 | 6/1981 | Mitsak | 48/206 |
| 4,275,687 | 6/1981 | Sasaki | 122/20 B |
| 4,318,366 | 3/1982 | Tompkins | 122/20 B |
| 4,327,670 | 5/1982 | Teller | 122/20 B |
| 4,344,568 | 8/1982 | Stewart et al. | 237/8 R |
| 4,451,003 | 5/1984 | de Mena et al. | 236/14 |

FOREIGN PATENT DOCUMENTS

| | | | |
|---|---|---|---|
| 0060194 | 4/1983 | Japan | 165/134 DP |

OTHER PUBLICATIONS

"Make Heaters 92% Efficient", by H. C. Mieth and J. E. Hardie, Hydrocarbon Processing, May 1979, pp. 134–144.

"Save Energy in Fired Heaters", by C. Bonnet, Hydrocarbon Processing, Mar. 1982, pp. 131–136.

*Primary Examiner*—Edward G. Favors

*Attorney, Agent, or Firm*—John F. Carney

[57] ABSTRACT

A system for recovering the waste heat normally exhausted in the atmosphere by blast furnace stoves or other variable temperature process heaters. The system comprises a heat exchange apparatus located in the exhaust stack, heat transfer means for carrying the waste heat absorbed from the exhaust gases to a location remote therefrom, and a second heat exchange apparatus for releasing the transferred waste heat for beneficial use at the remote location. This invention also includes a reservoir for storing the heat transfer fluid used in the system and also the reservoir acts as a heat sink to moderate the temperature variation of the heat transfer fluid. The system also includes means for controlling temperature of the first heat exchanger and means for controlling the temperature of the variable temperature process heater. The preferred heat transfer fluid is maintained as a liquid during its use in the system.

5 Claims, 2 Drawing Figures

VARIABLE TEMPERATURE WASTE HEAT RECOVERY SYSTEM

FIELD OF THE INVENTION

This invention relates to a system for recovering waste heat from a variable temperature process heater exhaust stack, and more particularly to a system comprising means for controlling temperature within the system.

BACKGROUND OF THE INVENTION

Considerable effort has been expended to develop waste heat recovery systems to recover waste heat normally exhausted in the atmosphere by industrial processing plants. Many of these systems involve heat exchange apparatuses and methods. Many of these apparatuses are used to transfer "process heat", as distinguished from waste heat, from one point in the process to another. Many of these heat exchangers utilize a liquid heat transfer medium. However, the temperatures and other conditions present in a waste heat recovery application are typically far more severe than those encountered in applications wherein process heat is being transferred.

U.S. Pat. No. 4,137,965, teaches a waste heat recovery system utilizing heat exchangers in combination with heat transfer liquids. This system also teaches temperature and pressure control means for the effective and safe recovery of waste heat.

Attempts to utilize these prior art heat recovery systems for variable temperature process heaters such as blast furnace stoves have met with difficulties. For example, in the blast furnace process because of the cyclic nature of the process, wide swings of 100° or more of the exhaust gases from the blast furnace stove are a given condition. By contrast, the waste heat recovery system of U.S. Pat. No. 4,137,965 presupposes a substantially uniform temperature of the exhaust gases.

SUMMARY OF THE INVENTION

This invention relates to a method and system or apparatus for recovering waste heat from a variable temperature process heater exhaust stack through which exhaust gases are discharged, the method including the steps of:

(a) providing a first heat exchanger within the exhaust stack such that the exhaust gases will flow across its surfaces;

(b) providing a second heat exchanger at a point remote from the exhaust stack such that a recipient fluid will flow across its surfaces;

(c) coupling the inlet of the second heat exchanger in communication with the outlet of the first heat exchanger, and the outlet of the second heat exchanger in communication with the inlet of the first heat exchanger through conduit means, so as to define a closed flow circuit;

(d) providing a reservoir for storing heat transfer fluid in communication with the closed flow circuit and acting as a heat sink for the heat of the heat transfer fluid, and wherein the amount of heat transfer fluid in the reservoir during operation of this method is at least equal to the amount of heat transfer fluid in the remainder of the closed flow circuit filled with heat transfer fluid;

(e) providing means for forcing heat transfer fluid to circulate through the closed flow circuit;

(f) providing heat transfer fluid in the closed flow circuit;

(g) controlling the temperature of the first heat exchanger to a temperature above the acid dew point of the exhaust gases surrounding the first heat exchanger; and (h) controlling the temperature of the variable temperature process heater to achieve the variable energy needs of an external process and to maintain the temperature of the process heater below the temperature at which significant degradation of the process heater takes place;

whereby, the heat transfer fluid will absorb waste heat from the exhaust gases as they pass through the first heat exchanger and release the recovered waste heat to the recipient fluid as it passes through the second heat exchanger. Preferably the method also includes the step of controlling the volume of the gases being fed to the burner of the heater. The heat transfer fluid is preferably a liquid under conditions within the system.

DESCRIPTION OF THE PREFERRED EMBODIMENTS

Figure 1:
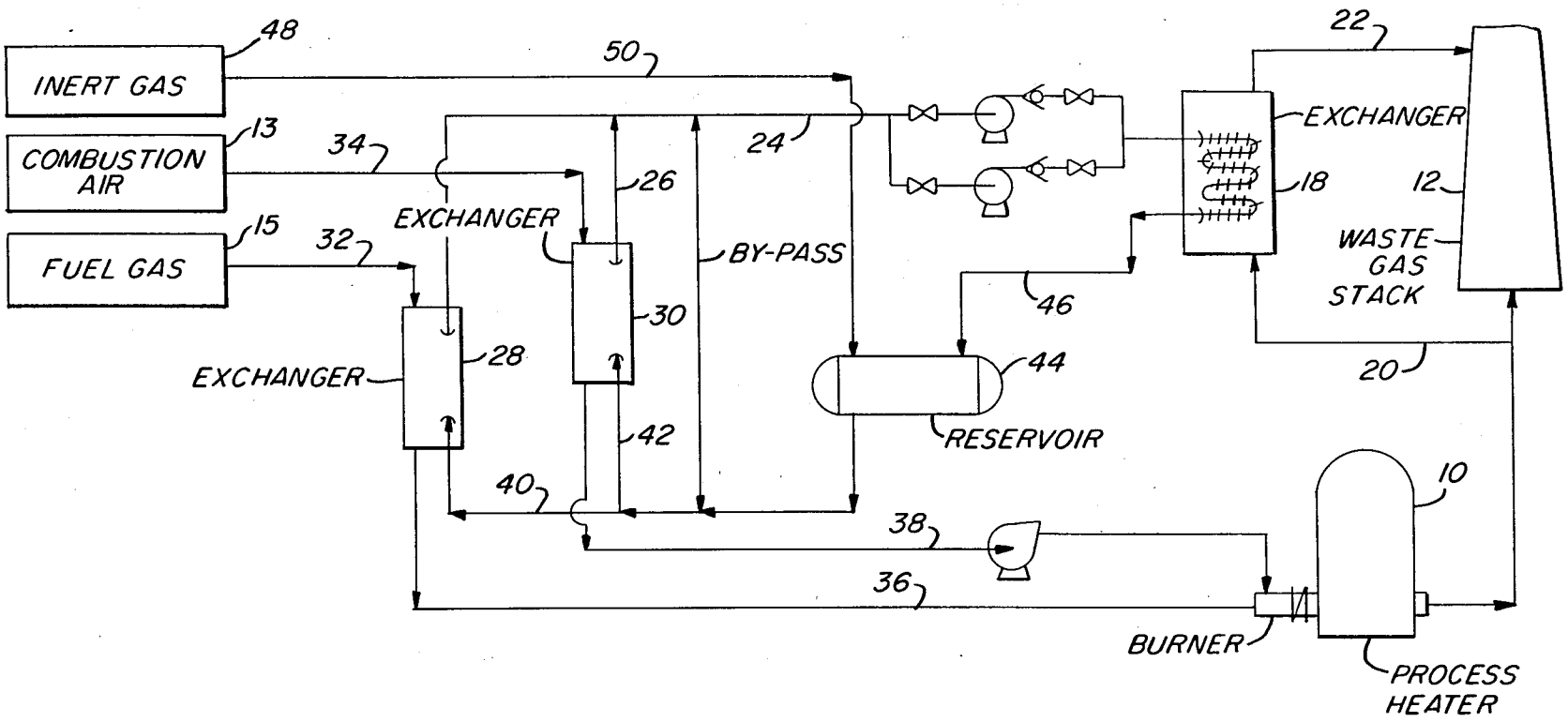
FIG. 1 is a schematic representation of the waste heat recovery system according to this invention for recovering the heat from exhaust gases from a variable temperature heater and reusing the recovered heat at one or more distant locations.

This invention operates in conjunction with independent process equipment such as a blast furnace system for producing iron from iron ore. In FIG. 1 the process equipment includes a variable temperature process heater 10, a waste gas stack 12, source of combustion air 13 and source of fuel gas 15, such air and fuel gas being fed to the process heater 10. The process heater is preferably a blast furnace stove containing refractory heat storage means.

This invention includes heat exchanger 18, preferably of the conventional finned coil type, in the waste gas stack 12 or connected thereto by conduits 20 and 22. Hot gases from the waste gas stack pass through conduit 20 into heat exchanger 18 where heat is transferred by indirect heat exchange to the heat transfer liquid in the heat transfer line. The heat transfer fluid leaves heat exchanger 18 through heat transfer line 46 to reservoir 44 which is also a heat sink which will hold at least the amount of heat transfer fluid in the remainder of the closed flow circuit which is filled with the heat transfer fluid. Preferably the amount of heat transfer fluid in the reservoir is at least about two times, and more preferably between two times and about five times, the amount of heat transfer fluid in the remainder of the closed flow circuit filled with heat transfer fluid. Inert gas source 48 such as nitrogen gas provides pressure through line 50 to reservoir 44. Preferably the pressure is sufficient to maintain the fluid in a liquid condition throughout the circuit. Preferably the means for moving the fluid in the closed flow circuit comprises pumps.

The heat transfer fluid leaves the reservoir 44 through heat transfer lines 40 and 42 to heat exchanger 28 and/or heat exchanger 30 for heating of the fuel gases passing through conduit 32 and the combustion air passing through conduit 34 to the respective heat exchangers. The heated fuel gas and combustion air passes from conduits 36 and 38, respectively, to process heater 10. Heat transfer fluid lines 24 and 26 remove the cooled heat transfer fluid from the respective heat exchangers and return it to heat exchanger 18.

The waste recovery system involving two or more heat exchangers for a given variable process heater are often part of a larger system involving at least three process heaters and preferably three to five process heaters per waste gas stack. In the preferred system for blast furnaces, three to five blast furnace stoves are utilized for each blast furnace and waste gas stack combination.

In exemplary blast furnace system involving three stoves, one blast furnace and one waste gas stack, each stove has a cycle involving 80 minutes of heating, during which time combustion air and fuel gas are fed into the stove; 10 minutes of switching, and 45 minutes in the off condition wherein gases are passed through the stove to pick up heat from the brick lining of the stove, and are then swept into the blast furnace for use in heating the iron ore, etc. therein. In such a system, preferably one stove will be in the off condition, another stove will be in the first part of the heating cycle and the other stove will be in the second part of the heating cycle.

The variable temperature process heater according to this invention is one that has a temperature variation of at least about 50° F. during a process cycle. The duration of such a process cycle is preferably between 15 minutes and 24 hours and more preferably between about 30 minutes and about 4 hours. The temperature of the exhaust gases from one stove preferably varies between about 100° F. and about 700° F., and the temperature of the combined exhaust gases from two or more process heaters is preferably between about 200° F. and about 600° F. and more preferably between about 350° F. and about 550° F.

The heat transfer fluid is preferably a liquid at the conditions under which the process is operated and thus has a higher heat transfer capacity than the exhaust gas, combustion air or fuel gas.

Preferably the temperature of the heat transfer fluid leaving the reservoir within the closed circuit is maintained within the 100° F. range such as between about 400° F. and about 500° F. and more preferably within a range of about 50° F., such as between about 425° F. and about 475° F.

Suitable heat transfer fluid for use in this invention includes one or more members of the group of o-dichlorobenzene, diphenyl-diphenyloxide eutectic, diaryl ethers, tri-aryl ethers, hydrogenated terphenyls, polychlorinated biphenyl, polyphenyl ether, alkyl-aromatic petroleum oil, alaphatic petroleum oil and pure lubrication oil.

In the preferred embodiment wherein the heat transfer fluid is a liquid, a nitrogen gas padding means is provided comprising a nitrogen gas tank coupled to the closed flow circuit through valve means, wherein the heat transfer fluid controls valve means to enable injection of the nitrogen gas into the closed flow circuit to thereby maintain the heat transfer fluid in a liquid state.

While reference is made to one or two heat exchangers, located at points remote from an exhaust stack heat exchanger, it will be understood any number of heat exchangers may be utilized to accomplish the purposes desired for the particular application.

Preferably the temperature of the first heat exchanger used in conjunction with the waste gas stack is controlled by measuring the temperature of the first heat exchanger and then adjusting one or more process variables which affect the temperature of this heat exchanger. Among the variables adjusted is the temperature of the heat transfer fluid entering the first heat exchanger. The temperature of the heat transfer fluid entering this first heat exchanger may in turn be varied by varying the amount of heat transfer fluid which bypasses the second heat exchanger.

Preferably the temperature of the first heat exchanger is measured by means of a temperature probe, preferably located on the side of the first heat exchanger closest to the outlet for the exhaust gases for such exchanger.

The fuel gas source shown in FIG. 1 may, for example, be blast furnace gas used in combination with natural gas, and a burner management system to maintain the desired flow and BTU content of the fuel gas stream.

Figure 2:
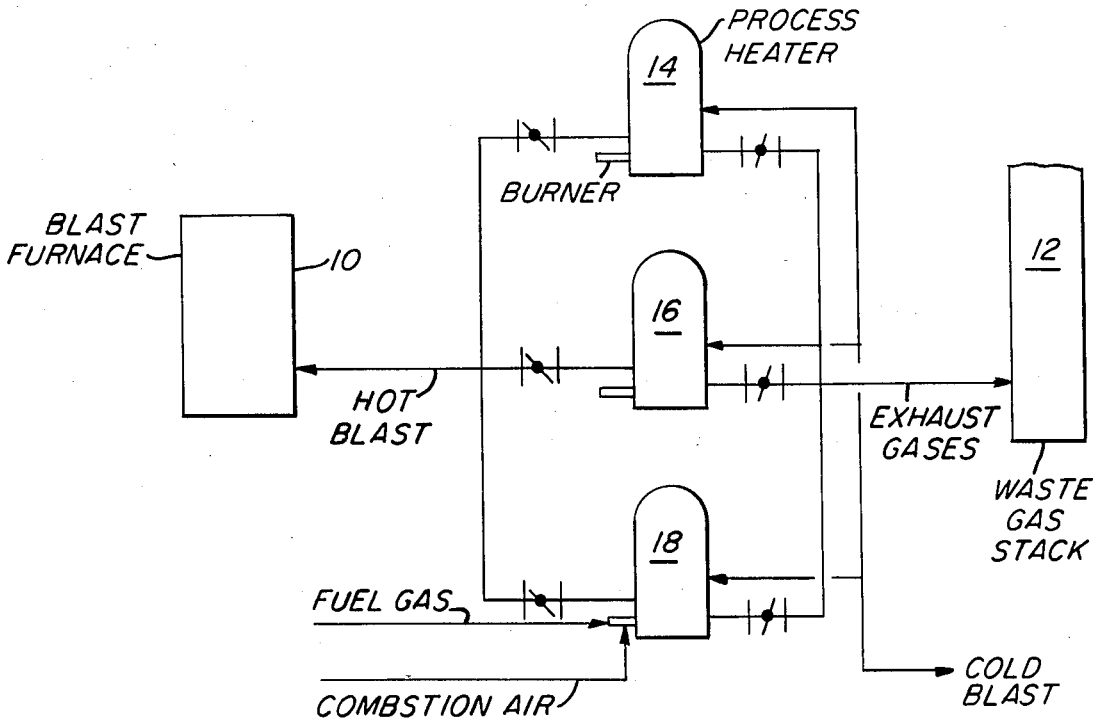
FIG. 2 is a schematic representation of the prior art blast furnace system comprising multiple heaters combined with a waste gas stack and a blast furnace.

FIG. 2 shows a typical blast furnace system to which this invention is applicable involving blast furnace 10, waste gas stack 12 and process heaters 14, 16 and 18. As described previously preferably the heaters are put in a sequence such that two of the three heaters are in different phases of the heating cycle while the third heater is in a cooling cycle. During the cooling cycle, gases are swept through the heater to pick up stored heat and transfer it to the blast furnace. During the heating cycle, combustion air and fuel gas are fed through the heaters and the waste gases are passed through various lines to the waste gas stack. This invention is applied to this blast furnace system to recover the heat that would normally be lost out the waste gas stack so that it can be utilized at remote locations, such as to heat fuel gases or combustion air being used by the process heaters.

The temperature of the variable process heater is preferably controlled by measuring the temperature of the variable process heater and then adjusting one or more process variables which affect the temperature of the process heater. Process variables which may be adjusted to control the temperature of the variable temperature process heater include the amount and temperature of the fuel and combustion air entering the process heater.

In the preferred process heater, lined with a refractory heat storage means, a flame at the bottom of the stove preferably produces a stove dome temperature between about 1000° F. and about 2600° F., and more preferably of about 2300° F.

A preferred embodiment includes a burner management system to monitor and control the following variables:

(1) preheat temperature of the combustion air,
(2) air/fuel ratio,
(3) stove dome temperature,
(4) blast furnace gas calorific value,
(5) natural gas enrichment,
(6) combustion air flow, and
(7) flue gas temperature at the inlet to the waste gas stack exchanger.

Because the heating by the process heater is a cyclic operation, an automatic on/off valve is preferably located on the outlet side of the preheater heat exchangers for the combustion air and fuel gas. When the combustion air fan is activated and the flow control valve opened, a circuit is completed that opens both automatic valves. On shut down, the operation is reversed closing the valves. This enables automatic sequencing of the process heater operation, thereby, simplifying operation.

We claim:

1. A waste gas recovery system for use with a process heater installation in which exhaust gases discharged from said installation are variable during each operating cycle, said system including a closed-loop heat transfer circuit through which a heat transfer liquid is circulated and having a first heat exchanger for extracting heat from said exhaust gases, a second heat exchanger adapted to pass a recipient fluid in heat transfer relation with said heat transfer liquid, and a reservoir for storing the heat transfer liquid circulated through said circuit, the improvement comprising said reservoir being operatively disposed in said heat transfer circuit intermediate the downstream end of said first heat exchanger and the upstream end of said second heat exchanger whereby heat transfer liquid heated in said first heat exchanger is passed to said reservoir prior to being passed to said second heat exchanger and said reservoir containing an amount of heat transfer liquid in excess of that contained in the remainder of said heat transfer circuit whereby variations in the temperature of said heat transfer liquid exiting said first heat exchanger are damped prior to entry of said heat transfer liquid into said second heat exchanger.

2. A waste heat recovery system according to claim 1 in which the temperature of the exhaust gases emitted from said process heater installation vary cyclically from about 200° F. to about 600° F. and the amount of heat transfer liquid contained in said reservoir is from two to five times that in the remainder of said heat transfer circuit.

3. A waste heat recovery system according to claim 1 or 2 in which said heat transfer liquid is selected from the group consisting of o-dichlorobenzene, diphenyl-diphenyloxide eutectic, di-aryl ethers, tri-aryl ethers, hydrogenated terphenyls, polychlorinated biphenyl, polyphenyl ether, alkyl-aromatic petroleum oil, alaphatic petroleum oil and pure lubrication oil.

4. A waste heat recovery system according to claim 3 in which the recipient fluid passed through said second heat exchanger in heat transfer relation to said heat transfer liquid is combustion air for supply to said process heater installation.

5. A waste heat recovery system according to claim 3 in which the recipient fluid passed through said second heat exchanger in heat transfer relation to said heat transfer liquid is gaseous fuel for supply to said process heater installation.

* * * * *